US006253914B1

(12) United States Patent
Berg

(10) Patent No.: US 6,253,914 B1
(45) Date of Patent: Jul. 3, 2001

(54) CADDY FOR WASHING GOLF BALLS

(75) Inventor: David G. Berg, White Lake, MI (US)

(73) Assignee: Pin-amax Golf Products, LLC, Bloomfield, MI (US)

( * ) Notice: Subject to any disclaimer, the term of this patent is extended or adjusted under 35 U.S.C. 154(b) by 0 days.

(21) Appl. No.: 09/250,734

(22) Filed: Feb. 16, 1999

Related U.S. Application Data

(60) Provisional application No. 60/075,011, filed on Feb. 17, 1998.

(51) Int. Cl.[7] ..... B65D 85/58; A63A 55/02

(52) U.S. Cl. ..... 206/315.9; 134/25.4; 134/201; 224/274

(58) Field of Search ..... 134/25.4, 25.5, 134/201; 206/315.9, 579; 220/485; 224/274

(56) References Cited

U.S. PATENT DOCUMENTS

| | | | | |
|---|---|---|---|---|
| D. 367,908 | | 3/1996 | Byers . | |
| 1,778,225 | * | 10/1930 | Morss | 206/315.9 |
| 2,757,698 | * | 8/1956 | Goodman | 206/315.9 |
| 3,777,933 | * | 12/1973 | Joliot | 206/315.9 |
| 4,106,678 | * | 8/1978 | Thomas | 206/315.9 |
| 4,730,728 | * | 3/1988 | Larkin | 206/315.9 |
| 4,850,483 | * | 7/1989 | Stack | 206/315.9 |
| 5,044,495 | * | 9/1991 | Wyslotsky | 206/315.9 |
| 5,341,928 | | 8/1994 | Jones et al. . | |
| 5,772,090 | * | 6/1998 | Rodriguez | 206/315.9 |
| 5,839,631 | * | 11/1998 | Hebert et al. | 206/315.9 |
| 5,898,968 | * | 5/1999 | Beattie | 206/315.9 |
| 5,951,075 | * | 9/1999 | Green | 206/315.9 |

* cited by examiner

*Primary Examiner*—Jim Foster
(74) *Attorney, Agent, or Firm*—Warn, Burgess & Hoffmann, PC

(57) ABSTRACT

The present invention provides a caddy for holding and washing golf balls. The caddy includes a plurality of enclosure walls defining a cavity. At least one of the walls has openings allowing fluid to enter the cavity to clean the golf balls. Top and bottom openings are also provided to allow balls to be placed into and removed from the cavity, respectively. In one embodiment, the bottom opening is closed by a door to prevent balls from leaving the cavity. In a second embodiment, a deformable elongated opening retains the balls in the cavity. The opening can be deformed by the application of a force to allow balls to selectively be removed from the cavity. A connector is also provided to secure the caddy with a support structure.

9 Claims, 4 Drawing Sheets

CADDY FOR WASHING GOLF BALLS

This application claims benefit under 35 U.S.C. 119(e) of prior U.S. Provisional Application No. 60/075,011, filed on Feb. 17, 1998.

BACKGROUND OF THE INVENTION

1. Field of the Invention

The present invention relates to a caddy for holding and washing balls. More specifically, the present invention relates to a ball caddy capable of holding several golf balls and that can be used in a dishwasher or similar device to wash the golf balls.

2. Description of the Prior Art

As golfers play golf, their balls typically get dirt or other debris on them. It is not always possible or desirable to wash the golf balls during the course of the golfer's round. Furthermore, it is common for golfers to find golf balls that have dirt or debris on them. It is desirable to have a ball caddy or carrier into which the golfer can place the dirty balls during his round for later cleaning. It is also desirable to allow the container to be placed, in its entirety into an environment in which it and the balls contained therein can be cleaned, such as for example, a dishwasher. It is thus desirable to have a structure that includes openings for allowing a washing fluid to pass therethrough to clean the ball. Further, the structure should be large enough to hold several golf balls, but no so large that it cannot fit into a dishwasher. Finally such a structure should have an opening at the top into which the dirty golf balls can be placed and an opening at the bottom from which the clean balls can be removed.

One ball caddy is described in U.S. Pat. No. Des. 367,908. This patent shows a generally square caddy for ball washing. The patent, however, does not show any openings at the top, into which a soiled ball can be placed, nor does it show an opening at the bottom, through which clean balls can be removed.

SUMMARY OF THE INVENTION

According to the present invention, there is provided a golf ball caddy that comprises a plurality of enclosure walls that define a cavity therebetween. The cavity is for receiving golf balls. At least one of the enclosure walls has openings therein adapted to allow fluid to enter the cavity. The caddy also includes a top opening adapted to allow golf balls to be placed into the cavity therethrough. The caddy also includes a bottom opening adapted to allow balls to be removed from the cavity therethrough.

By providing a device with a top opening, soiled golf balls can be added to the caddy, while the clean balls remaining in the caddy can be removed from the bottom opening. The caddy can be placed in a dishwasher to remove debris from the golf balls.

Another advantage of the present invention is that the caddy is sized to allow several golf balls to be stored and cleaned and yet is compact enough to allow it to fit inside of a dishwasher.

Another advantage of the present invention is that the caddy is portable and includes a connector that allows the caddy to be removably secured to the golfer's bag, cart or the like so that after the round, the caddy can be easily transported to the dishwasher.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE DRAWINGS

Figure 1:
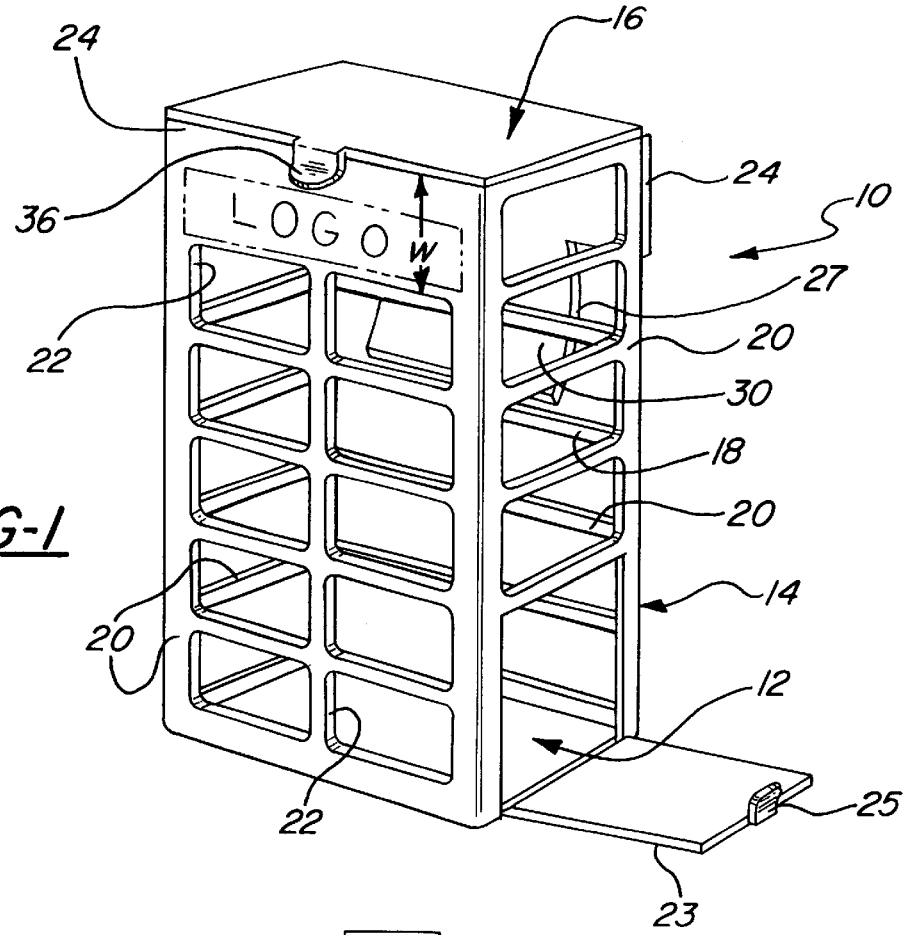
FIG. 1 is a perspective view of the present invention.

A ball caddy according to the present invention is generally shown at 10 in FIGS. 1–4. The caddy generally comprises a bottom, generally indicated at 12, an enclosure, generally indicated at 14 and a top, generally indicated at 16. The bottom 12 is connected to the enclosure 14, which defines an opening 18 for receiving the golf balls. The top 16 is pivotally connected to the enclosure to close the opening 18 to thereby retain the golf balls in the caddy 10.

The bottom 12 preferably is made of a plastic material. Further, the bottom 12 is preferably, but not necessarily a solid surface. It may be desirable that the bottom 14 has a lattice structure to allow more efficient cleaning of the balls in the caddy 10. Further, the bottom 12 may have an inclined or ramped structure to facilitate removal of the balls as will be described below.

The enclosure 14 extends upwardly from the bottom 12. The enclosure 14 comprises a lattice structure that extends from the outer periphery of the bottom 12 upwardly to define an opening or cavity 18 therein for receiving the golf balls. As shown, the enclosure 14 comprises four walls 20 defining a rectangular tube having the opening or cavity 18 therein. It will be appreciated that the enclosure 14 may take any geometry capable of defining an opening or cavity 18 for holding the balls.

It is preferred that each of the enclosure walls 20 be made of a plastic. Furthermore, each wall 20 has a lattice structure. The lattice structure of the enclosure walls 20 is defined by a plurality of openings 22 in the enclosure walls 20. The openings 22 should be large enough to let liquid pass therethrough to clean the balls, but not so large as to let a golf ball pass therethrough. At least one of the enclosure walls 20 includes a solid portion 24 at the top thereof. In the preferred embodiment, both of the front and rear enclosure walls 20 include a solid portion 24.

The width (w') of the solid portion 24 can be made large enough to support an advertisement, company logo, or the like. This is desirable so that the caddy 10 can be used as a novelty promotional item. It is preferable, however, that the width (w') not be too large, so as to unduly interfere with the washing of the balls as will be subsequently described.

One of the enclosure walls 20 and most preferably, one of the side enclosure walls 20 includes a bottom door 23 thereon. The bottom door 23 is located at the bottom most edge of the enclosure wall 20 and is pivotal relative thereto, preferably by a living hinge. Thus, the bottom door 23 is moveable between open and closed positions. The bottom door 23 is sized such that its height and width are each slightly larger than the diameter of one golf ball. The bottom door 23, when open presents a ball removal opening 31 that is also slightly larger in height and width than one golf ball. In this manner, when the bottom door 23 is opened, a golf ball can be removed from the opening 18. The bottom door 23 includes a flange or boss 25 that engages the lattice structure of the enclosure wall 20. In this manner, the door is snap fit to the enclosure wall 20 SO that it can be closed, and held in place by the friction fit between the flange 25 and enclosure wall 20.

The solid portion 24 on the rear enclosure wall 20 is for supporting a connector generally indicated at 26. The connector 26 is used to attach the caddy 10 with a support structure, such as a golf bag, golf cart or the like. In the preferred embodiment, the connector 26 comprises a flange 27 connected to the solid portion 24 of the rear enclosure wall 20. The flange 27 extends outwardly from the solid portion 24 then downwardly, creating a gap 30 between the flange 27 and the enclosure wall 20.

Figure 4:
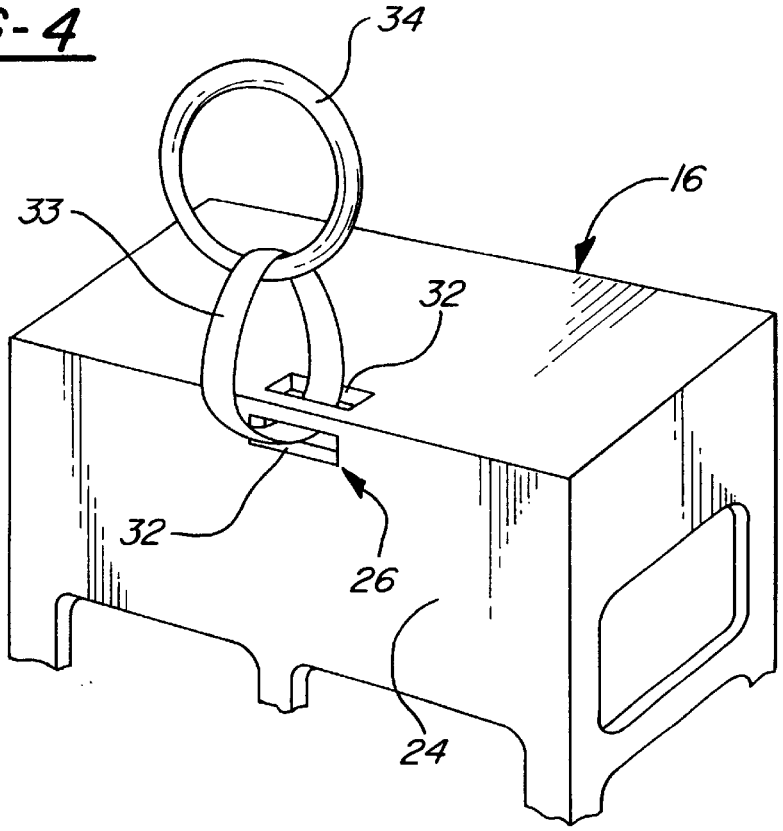
FIG. 4 shows an alternate connector arrangement.
Figure 6:
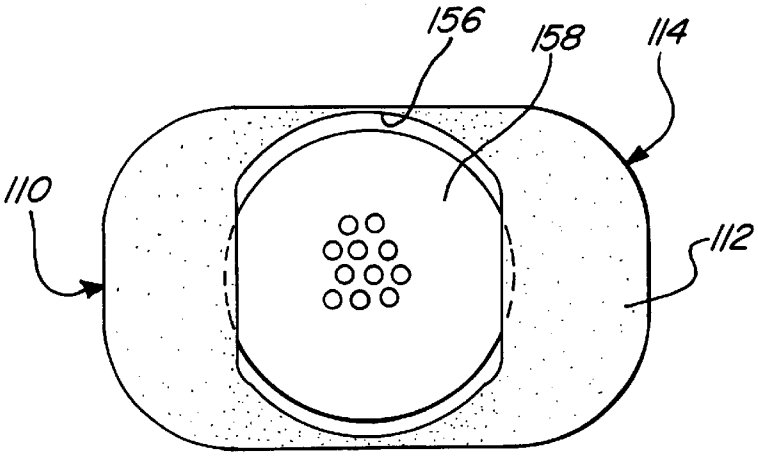
FIG. 6 shows a bottom view of the alternate embodiment with the opening in the closed position.

It will be appreciated that the connector 26 may take any configuration capable of securing the caddy 10 with a support structure. For example, an alternate connector 26 is shown in FIG. 4. As shown the connector 26 includes an opening 32 through both of the top 16 and solid portion 24 of the rear enclosure wall 20. A tether 33 is placed through the opening 32, to which a clasp 34 is secured. The clasp 34 is capable of attachment to a suitable support structure. The clasp 34 can be secured directly in the opening 32, eliminating the need for a tether 33.

The top 16 preferably comprises a solid surface that is pivotally connected, such as with a living hinge, to at least one enclosure wall 20. As shown in FIG. 1, the top 16 is pivotally connected to the rear enclosure wall 20. The configuration of the top is such that it encloses the opening 18 defined by the enclosure walls 20 and the bottom 12. Thus, the top 16 acts as a door that can be opened and closed, with respect to the enclosure walls 20. The top 16 also snap fits with the front enclosure wall 20 to keep the lid in a closed position. The snap fit is accomplished by including a flange or boss 36 on the front of the top 16. The front enclosure wall includes a hole or detent 38 for receiving and retaining a portion the flange 36. To unsnap the top 16 so that it can be opened, all that is necessary is to apply a force to the top 16 sufficient to remove the flange 36 from the hole or detent 38.

It will be appreciated that the top 16 can take any shape capable of closing the opening 18 to retain golf balls in the caddy 10. Further, while it is preferred that the entire top 16 pivot relative to the enclosure wall 20, it is only necessary the a portion of the top 16 pivot that is sufficient to allow the insertion of a golf ball into the opening 18. Similarly, while the top 16 is shown to be a solid surface, it may be made of a lattice structure as with the enclosure walls 20.

It will further be appreciated that caddy 10 may take any alternate configuration. For example, the height of the caddy 10 may be less than its width. Similarly, the caddy 10 may be contoured in a slightly arcuate fashion such that the front and back walls may take the general contour of a portion of a golf bag. Similarly, the side walls 20 may bulge slightly to accommodate more golf balls.

Figure 2:
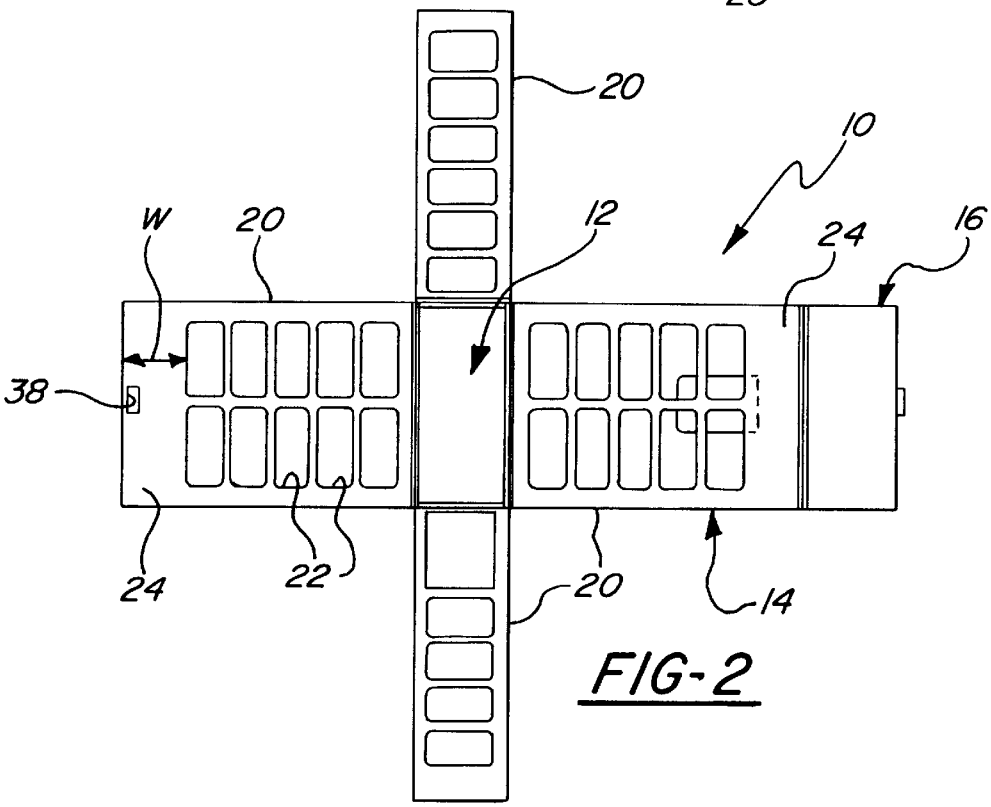
FIG. 2 is a top plan view of the present invention before assembler.
Figure 3:
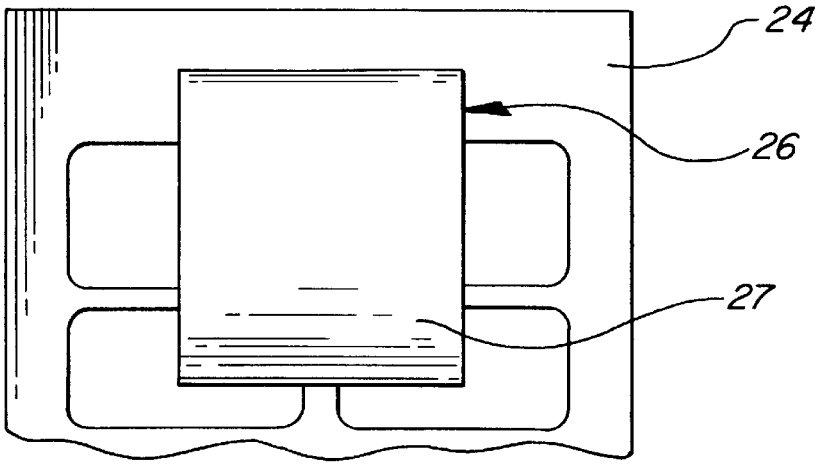
FIG. 3 shows a rear view partially broken away showing a connector agreement.

The preferred making of making a caddy 10 according to the present invention as follows. Each of the bottom 12, enclosure walls 20 and top 16 are molded as an integral unit of a plastic material (FIG. 2). The enclosure walls 20 are each separately connected to the bottom 12 by a living hinge. The top 16 is connected to one of the enclosure walls, preferably the back enclosure wall 20 by a living hinge. The four enclosure walls 20, once molded, are pivoted, at the living hinge upwardly from the base. The sides of adjacent walls 20 are snap fit together with suitable snap closures (also molded into the walls 20) to secure the enclosure walls 20 to form the opening or cavity 18 therebetween. The top 16 can then be closed, by pivoting it relative to the enclosure wall 20 along the living hinge. The connector 26 is then attached to the caddy 10 so that the caddy can be secured to a suitable support structure.

To use the caddy 10, the caddy 10 is assembled as above. The golfer opens the top 16 and places a few golf balls in the caddy 10. The top 16 is then closed. The golfer can then secure the caddy 10, via the connector 26 to his golf bag. As needed, the golfer can open the bottom door 23 and remove a golf ball from the opening or cavity 18. Once the ball has been removed, the door 23 is closed and snap fit to the enclosure wall 20. If a golfer soils his ball, or find a soiled ball, he can add it to the top of the opening or cavity 18, by opening the top 16 and placing the ball in the opening or cavity 18. The bottom door 23 can then be opened so the golfer can remove a clean golf ball. The bottom door 23 is then closed. By adding the soiled balls to the top of the opening or cavity 18, and removing clean balls through the door 23 at the bottom of the opening or cavity 18, the golfer can for the most part, keep the clean useable balls readily available and separate from the soiled balls.

This process is then repeated throughout the round. At the end of the round, the golfer may have accumulated a substantial number of soiled golf balls. The golfer can then remove the caddy 10 from its support structure and place it in any washing device. Most preferably, the caddy 10 can be directly placed in a dishwasher to remove the dirt and debris from all of the golf balls in the caddy. Once the balls have been cleaned in the dishwasher, the caddy 10 is removed and reattached to the support structure. All of the balls are then clean and ready for reuse.

It will be appreciated that to optimize water flow through the opening or cavity 18 and enhance the cleaning of the balls therein, the openings 22 in the enclosure walls 20 should be sized to permit as much water flow as possible, without being so large as to allow passage of a golf ball. Similarly, it may be desirable to provide a lattice structure on the top 16 and bottom 12 to further increase the flow water into the opening or cavity 18.

An alternate preferred embodiment is shown in FIGS. 5–9. Like numerals are used to describe like components will be used, but will be offset by 100.

Figure 7:
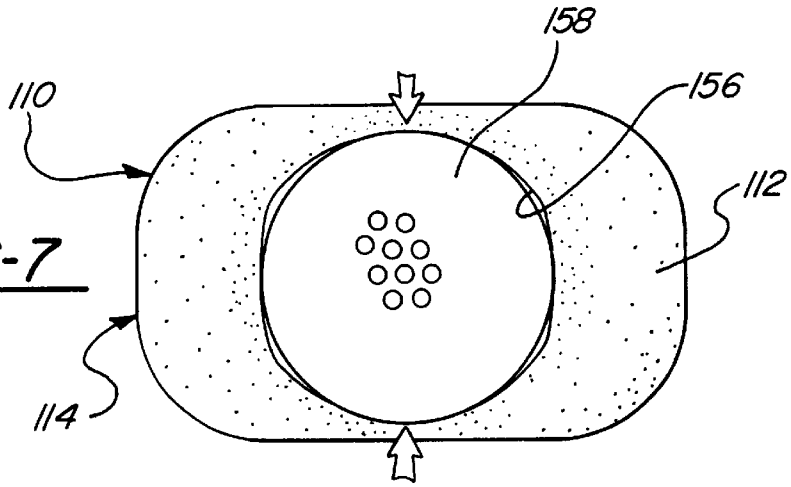
FIG. 7 shows a bottom view of the alternate embodiment with the oP ping in the open position.
Figure 5:
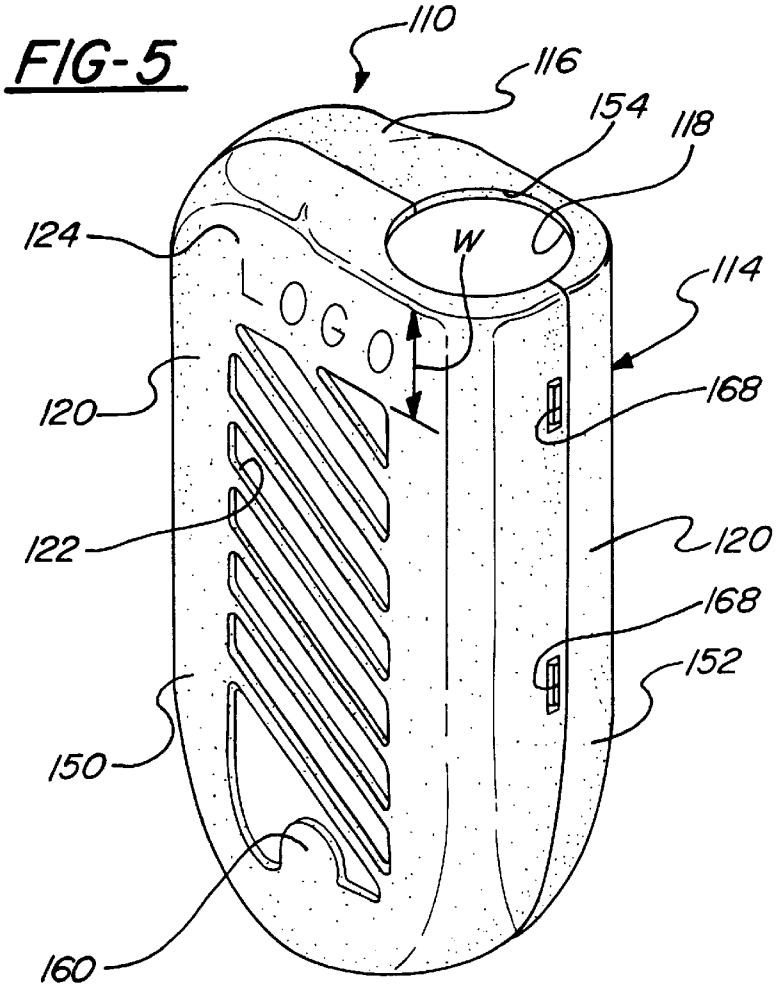
FIG. 5 shows a perspective view of an alternate embodiment of the present invention.
Figure 9:
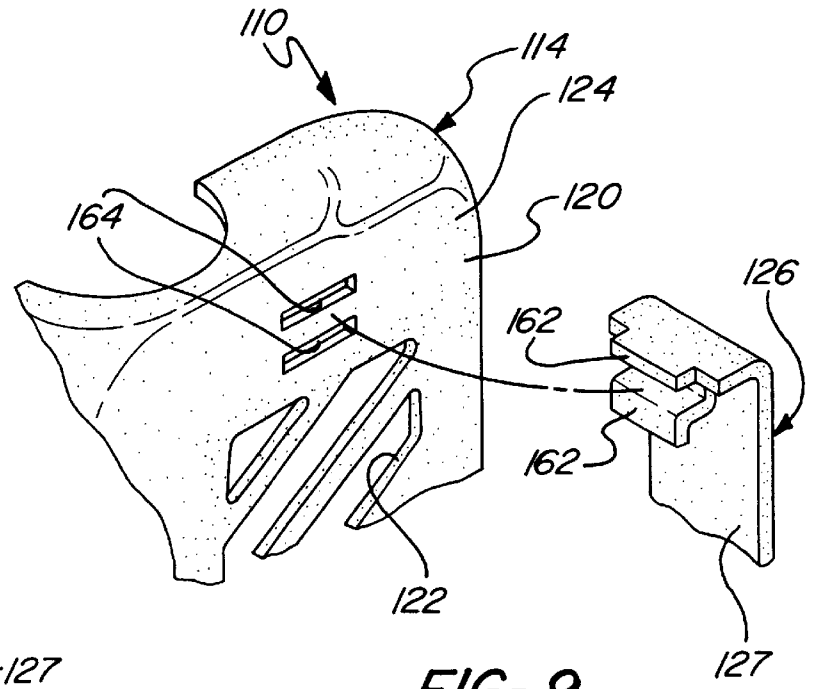
FIG. 9 shows an exploded view of the alternate embodiment partially broken away.
Figure 8:
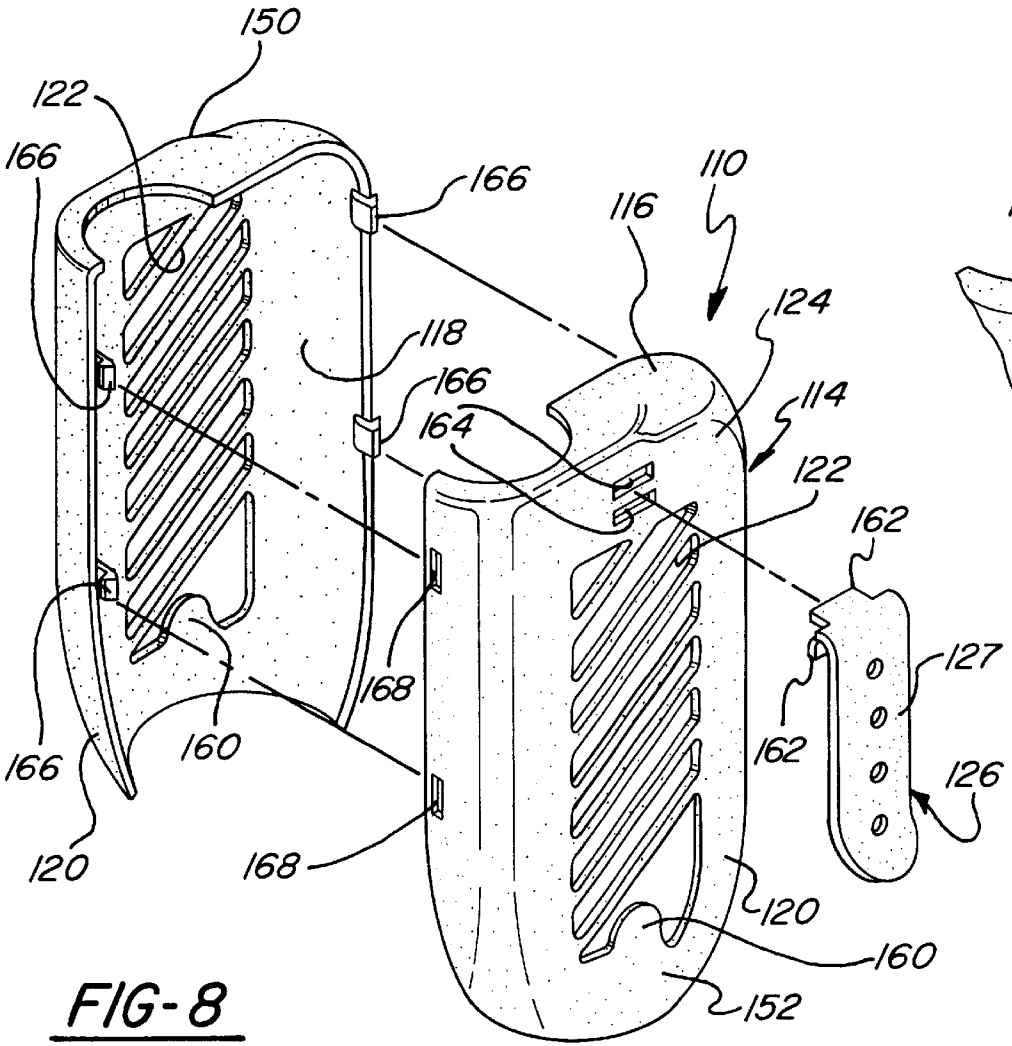
FIG. 8 shows an exploded view of the alternate embodiment.

An alternate ball caddy is generally shown at 110 in FIGS. 5–9. The caddy 110 generally comprises an enclosure generally indicated at 114. The enclosure 114 is defined by a pair of enclosure components 150,152 (as best seen in FIG. 8). Preferably, the enclosure components 150,152 are made of plastic. The enclosure components 150,152 connect together to form the enclosure 114. When the components 150,152 are connected, they define a bottom 112, top 116, and a plurality of enclosure walls 120. The enclosure walls 120, bottom 112 and top 116 define an opening or cavity 118 therebetween for holding the golf balls. Most preferably, the opening or cavity 118 is large enough to receive six golf balls.

The top 116 has a ball receiving opening 154. The diameter of the ball receiving opening 154 approximates the diameter of a golf ball. It is preferably sized so that a standard golf ball will contact the sides of the ball receiving opening 154 but can be pushed through with minimal force. With the sizing of the receiving opening 154 made in this manner, golf balls can be pushed through the receiving opening 154 without much force, but golf balls will not fall out of the receiving opening 154 during use of the caddy 110.

The bottom 112 has an opening 156 therein. The opening 156, in its undeflected, closed position (FIG. 6), is shaped such that it can retain a golf ball 158. The opening 156, however, is deformable in response to a force applied in the direction of the arrows of FIG. 7. The opening 156 then distorts to its deflected, open position (FIG. 7). In this deflected position, the opening 156 deflects and changes shape (as between FIGS. 6 and 7) to such a shape that the golf ball 158 can pass through the opening 156.

In the undeflected, closed position (FIG. 6), the opening 156 is elongated and the edges or sides of the opening 156 are spaced less than the diameter of a golf ball 158 such that they retain the golf ball 158 in the opening 118. A space or gap is also provided on either end of the golf ball 158. But, because the enclosure 114 is made from plastic, it can be deformed. Thus, by placing a force on the opening 156 (as will be described below) in the direction of the arrows (FIG. 7) causes the bottom 112 to flex, which in turn elongates the opening 156 to a point where the golf ball 158 can pass through the opening 156 (FIG. 7). That is, the gap closes down slightly and the side walls or edges flex outwardly such that the opening 156 is slightly larger than the diameter of a golf ball 158. Further, the bottom 112 is preferably contoured to direct a golf ball 158 to the opening 156. It will be appreciated that the opening 156 should be sized and shaped so that a golf ball 158 will not readily pass through the opening 156 during normal use, but can be deformed in response to a reasonable force to allow a golf ball 158 to pass threrethrough. If not enough of the golf ball 158 engages the sides of the opening 156 when in the closed state (FIG. 7), the golf balls 158 may vibrate out of the opening 156 during normal use. This is, of course, undesirable. Similarly, if too much of the golf ball 158 engages the sides or edges, it may require too much force to elongate the opening 156 to allow the golf ball 158 to pass through the opening 156. This too, is undesirable.

The walls 120 of the enclosure components 150,152 have a lattice structure. The lattice structure is defined by a plurality of openings 122 in the walls 120 of the enclosure components 150,152. The openings 122 are preferably large enough to let liquid pass through to clean the golf balls 158 in the opening or cavity 118, but not large enough to let a golf ball 158 pass through. At least one of the enclosure components 150,152 includes a solid portion 124 at the top thereof. In the preferred alternate embodiment, both enclosure components 150,152 include a solid portion 124.

The width (w') of the solid portion 124 can be made large enough to support an advertisement, company logo, or the like. This is desirable so that the caddy 110 can be used as a novelty promotional item. It is preferable, however, that the width (w') not be too large so as to unduly interfere with the washing of the golf balls 158.

The front and rear enclosure walls 120 each include a force receiving surface comprising a squeeze tab 160. The squeeze tabs 160 are connected to the walls 120 near the bottom. The squeeze tabs 160 are connected to a solid portion of the enclosure walls 120. Thus, by simultaneously squeezing the tabs 160 in a direction toward one another (in the direction of force shown in FIG. 7), the operator, in turn, places the necessary forces on the opening 156 to cause it to elongate and thereby allow a golf ball 158 to pass through the opening 156. Of course, the force could also be applied directly to the solid portion of the enclosure walls 120.

The solid portion 124 on the rear enclosure wall 120 is for supporting a connector, generally indicated at 126. The connector 126 is used to attach the caddy 110 with a support structure, such as a golf bag, golf cart or the like. In the preferred embodiment, the connector 126 comprises a flange 127 snap fit via suitable snap fit connectors 162 which mate with corresponding snap fit receivers or slots 164 in the rear enclosure wall 120. The flange 127 extends downwardly and outwardly from the solid portion 124 creating a gap between the flange 127 and the rear enclosure wall 120.

As with the first embodiment described above, will be appreciated that he connector 126 may take any configuration capable of securing the caddy 110 with a support structure.

As further described above, it will be appreciated that the caddy 110 may take any alternate shape.

The preferred method of making the alternate caddy 110 is as follows. Each of the enclosure components 150,152 and flange 127 are preferably molded as separate pieces. One of the enclosure components 150 includes integral hooks 166. The other of enclosure components 152 includes receiving slots 168 for receiving the hooks 166 in a snap fit relationship. Thus, the enclosure components 150,152 are aligned and the hooks 166 are inserted into the slots 168 to lock the enclosure components 150,152 together, to form the opening or cavity 118 therebetween. The flange 127 is then connected to the enclosure component 152 by aligning the snap fit connectors 162 with the slots 164 and securing them together in a snap fit relationship.

While one method of connecting its components together has been shown, it will be appreciated that any method of connecting the enclosure components 150,152 and connector 126 is contemplated within the scope of the present invention.

To use the caddy 110, the golfer puts a few golf balls 158 into the opening or cavity 118 by pushing them through the top opening 154. The golfer can then secure the caddy 110, via the connector flange 127 to his golf bag. As needed, the golfer can squeeze the tabs 160 toward one another which, in turn, deforms the bottom opening 156 to allow a golf ball 158 to fall out of the opening or cavity 118 and into the golfer's hand. Once the golf ball 158 exits the opening or cavity 118, the golfer simply releases the squeeze tabs 160 and the bottom opening 156 returns to its closed state to prevent more balls from passing out of the opening or cavity 118. If a golfer soils his golf balls, or finds a soiled ball, he can add it to the top of the opening or cavity 118 by placing it in through the top opening 154. The golfer can then remove a clean ball by squeezing the tabs 160. By adding the soiled balls to the top of the opening or cavity 118, and removing clean balls through the bottom opening 156, the golfer can, for the most part, keep clean useable balls readily available and separate from the soiled balls.

This process is then repeated throughout the round. At the end of the round, the golfer may have accumulated a substantial number of soiled golf balls. The golfer can then remove the caddy 110 from its support structure and place it in any washing device. Most preferably, the caddy 110 can be directly placed in a dishwasher to remove the dirt and debris from all of the golf balls in the caddy. Once the balls have been cleaned in the dishwasher, the caddy 110 is removed and reattached to the support structure. All of the balls are then clean and ready for reuse.

It will be appreciated that to optimize water flow through the opening or cavity 118 and enhance the cleaning of the balls therein, the openings 122 in the enclosure walls 120 should be sized to permit sufficient water flow. The openings 122 should not be so large, however, as to allow passage of a golf ball.

The invention has been described in an illustrative manner, and it is to be understood that the terminology which has been used is intended to be in the nature of words of description rather than of limitation. Obviously, many modifications and variations of the present invention are possible in light of the above teachings. It is, therefore, to be understood that within the scope of the appended claims, the invention may be practiced otherwise than as specifically described.

What is claimed is:

1. A golf ball caddy comprising:

a plurality of enclosure walls and a bottom, each of said enclosure walls extending from said bottom to define a cavity therebetween for receiving golf balls;

a top opening adapted to allow golf balls to be placed in said cavity therethrough; and an elongated bottom opening having sides spaced apart less than the diameter of a golf ball when in a closed position and being deformable from said closed position to an open position wherein said bottom opening deforms such that said sides expand outwardly to a distance slightly greater than the diameter of a golf ball in response to an inwardly directed force applied to said bottom opening to allow golf balls to be removed from said cavity therethrough.

2. A caddy as set forth in claim 1 further including at least two surfaces on said enclosure walls adapted to receive said inwardly directed force and transmit same to said bottom opening to move said bottom opening between said closed and said open positions.

3. A caddy as set forth in claim 2 wherein said surfaces comprise tabs connected to said enclosure walls.

4. A caddy as set forth in claim 3 wherein said side walls include a plurality of openings therethrough adapted to allow fluid to enter said cavity, at least one of said openings being spaced from said bottom.

5. A caddy as set forth in claim 4 wherein at least one enclosure walls has a solid area to define a printable surface.

6. A caddy as set forth in claim 4 wherein said enclosure walls are formed as two pieces and snap fit together to define the cavity therebetween.

7. A caddy as set forth in claim 1 wherein said top opening is of a diameter slightly less than the diameter of a golf ball.

8. A caddy as set forth in claim 1 further including a connector adapted to secure said caddy with a support structure.

9. A caddy as set forth in claim 8 wherein said connector comprises a flange, said flange adapted to be snap fit to one of said enclosure walls and extending downwardly and outwardly therefrom.

* * * * *